United States Patent [19]

Gabourie et al.

[11] Patent Number: 4,995,671

[45] Date of Patent: Feb. 26, 1991

[54] SEAT LEG SYSTEM WITH STABILIZER BAR

[75] Inventors: Greg Gabourie, Ajax; Steve Fox, Keswick, both of Canada

[73] Assignee: Global Upholstery Co., Ltd., Downsview, Canada

[21] Appl. No.: 472,861

[22] Filed: Jan. 31, 1990

[30] Foreign Application Priority Data

Feb. 9, 1989 [CA] Canada ..... 590665

[51] Int. Cl.[5] ..... A47C 16/00

[52] U.S. Cl. ..... 297/439; 108/154; 248/188.91

[58] Field of Search ..... 297/439, 461, 440; 248/188.91, 440; 108/130, 131, 115, 143, 154

[56] References Cited

U.S. PATENT DOCUMENTS

| | | | |
|---|---|---|---|
| 2,240,395 | 4/1941 | Evans | 248/188.91 X |
| 2,272,329 | 2/1942 | Schermerhorn | 248/188.91 X |
| 2,514,061 | 7/1950 | Hoop | 108/130 |
| 2,650,147 | 8/1953 | Savner | 108/154 |
| 2,789,631 | 4/1957 | Vosbikian et al. | 248/188.91 X |
| 3,163,468 | 12/1964 | Koch | 297/439 |
| 3,267,888 | 8/1966 | Carlson | 248/188.91 X |
| 3,393,940 | 7/1968 | Ellsworth et al. | 297/439 |

*Primary Examiner*—José V. Chen

*Attorney, Agent, or Firm*—McFadden, Fincham, Marcus & Allen

[57] ABSTRACT

A chair has four legs. Pairs of legs are connected by a crossbar to form two leg assemblies. Both legs assemblies are in turn connected by a pre-torqued resilient brace, which is joined to each leg assembly by a wedge joint. The torque in the brace tends to hold the joint together.

6 Claims, 2 Drawing Sheets

FIG.1.
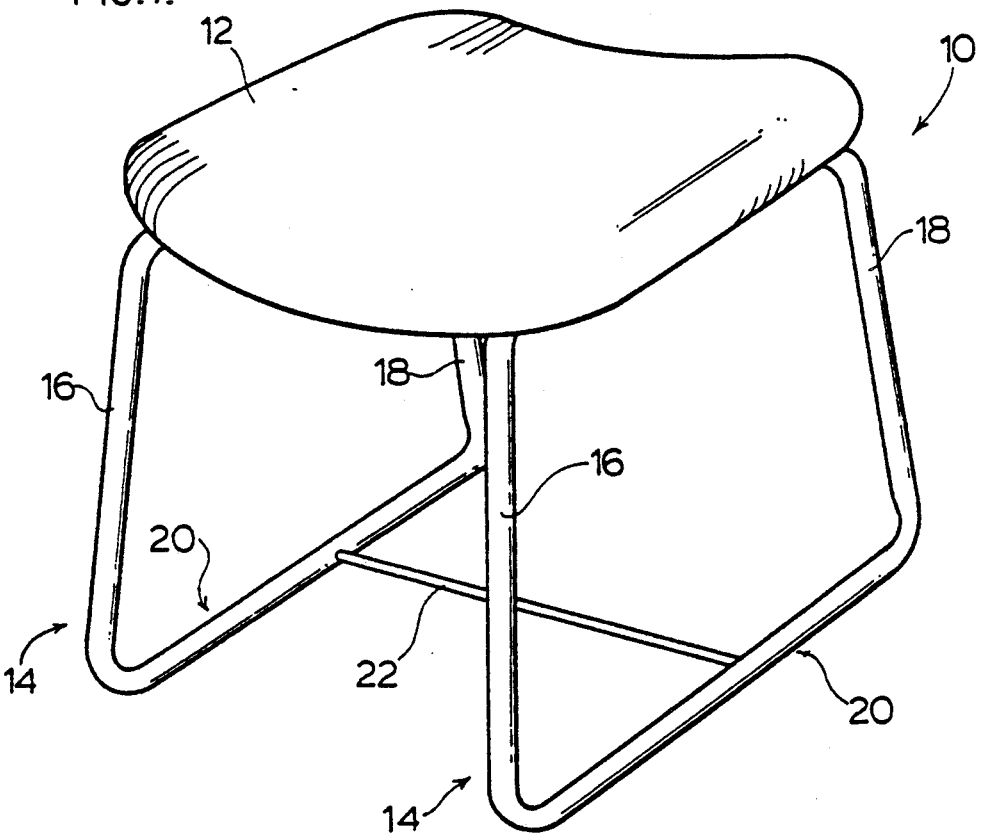
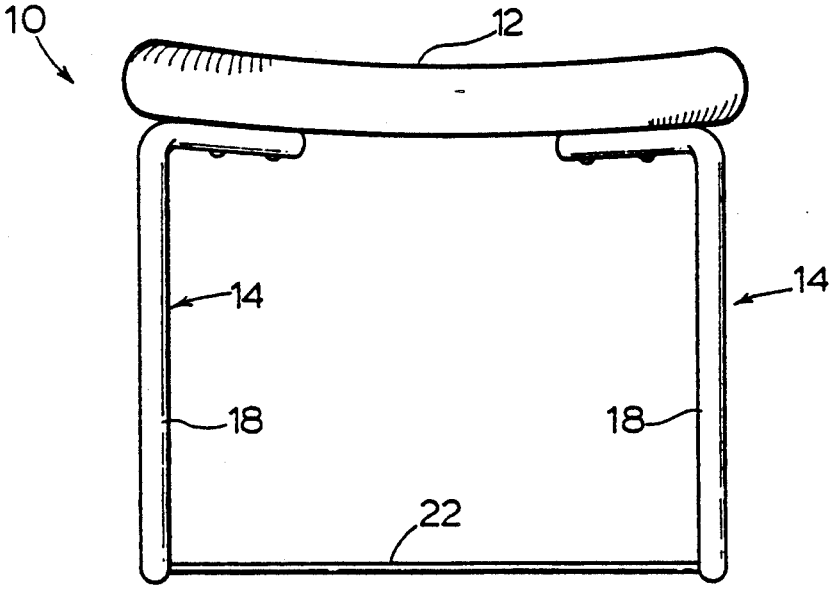
FIG.2.

SEAT LEG SYSTEM WITH STABILIZER BAR

FIELD OF THE INVENTION

This invention relates to a novel construction of chairs, primarily those with tubular metal legs, and to a method of construction of these chairs.

BACKGROUND OF THE INVENTION

Chairs having tubular metal legs are well known; their legs are often cross-braced, with the braces welded together. To manufacture and assemble chairs having this type of leg and brace is often expensive and labour intensive, requiring welding jigs and relatively skilled labour. Each leg or leg assembly must be retained in place and the braces spot welded, screwed or riveted into position. Unless the joints are firm (for instance welded), the braces may move slightly when the chair is used; and, over time, the joints will tend to weaken as they are stressed. A disadvantage of many conventional chairs is their need for factory assembly, a more compact and economical shipping arrangement being possible with chairs which may be assembled at the retail store, or even by the ultimate consumer.

SUMMARY OF THE INVENTION

The present invention provides a novel construction in which the legs of a chair are braced without welds, rivets or screws and helps to overcome some of the difficulties of the prior art.

The invention is generally a chair, which has:

(i) a seat mounted on two leg assemblies;

(ii) each leg assembly comprising a air of legs connected by a crossbar; and (iii) a resilient brace, attached to each leg assembly by a wedge joint, where the brace is pre-torqued to bias the joint together.

One embodiment of the invention is a chair comprising a seat with two U-shaped tubular metal leg assemblies, consisting of two legs representing the vertical parts of the 'U' and a crossbar, representing the bottom of the U. The leg assemblies are fastened to the underside of the seat. Each leg assembly is braced to the other by a resilient brace, which connects the crossbars. The brace is attached to the crossbar by two wedge joints, consisting of a hole through at least one wall of the tubular metal crossbar, and two angled ends of the brace, so that one end of the brace may be inserted into the hole, slightly torqued and the other end inserted into the hole on the other leg assembly.

A method of assembly of this embodiment involves securing one of the two leg assemblies to the underside of the seat. This is followed by insertion of each end of the brace into the hole in each crossbar, and then securing the second leg assembly to the underside of the seat. The brace will tend to keep the second leg assembly in approximately the correct position to be secured to the seat. The brace will also help to add strength to the chair without a weld, screw or rivet.

BRIEF DESCRIPTION OF THE DRAWINGS

An embodiment of the invention, being exemplary and not limiting, is described, reference being made to the accompanying drawings, wherein:

FIG. 1 is a perspective view;

FIG. 2 is an end elevation;

DETAILED DESCRIPTION OF PREFERRED EMBODIMENTS

Figure 3:
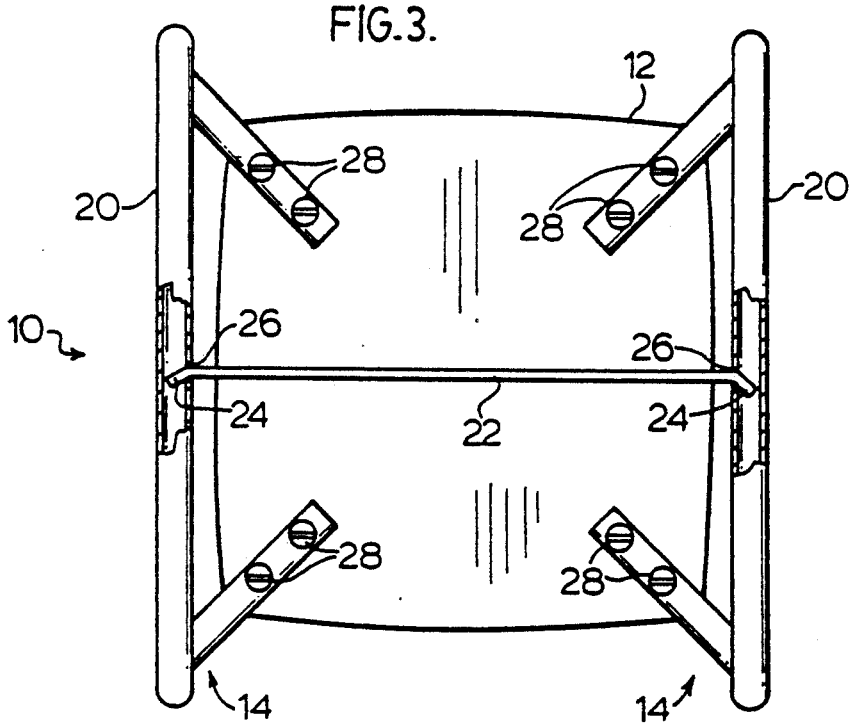
FIG. 3 is an inverted plan view.
Figure 4:
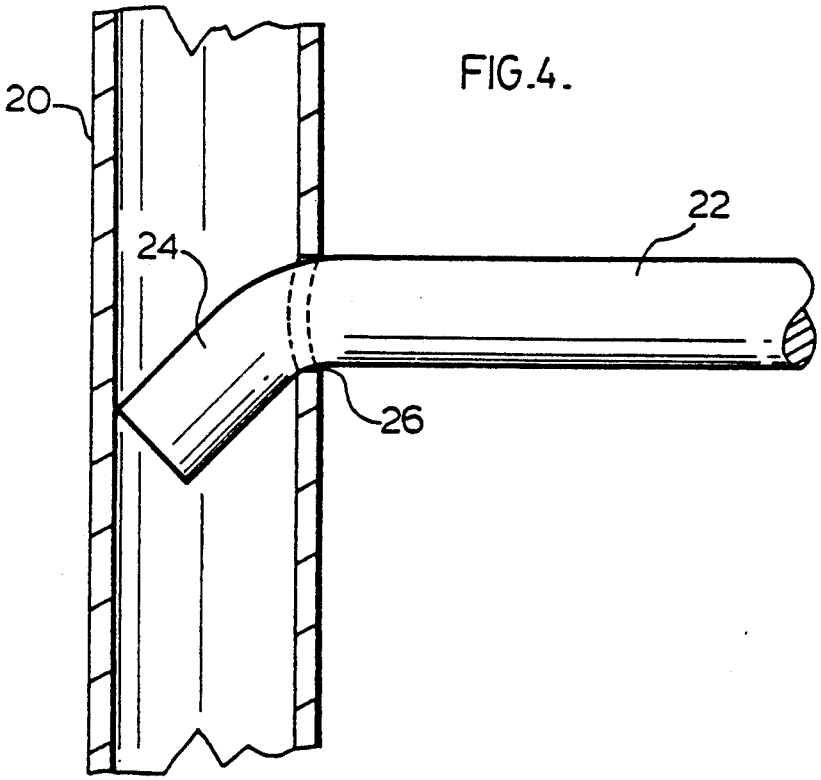
FIG. 4 is an enlarged detail of a portion of FIG. 3.

Referring to FIGS. 1, 2 and 3, the chair of a first embodiment 10 is a stool having a seat 12 and a pair of U-shaped leg assemblies 14 of tubular metal.

The upright legs 16, 18 of each leg assembly 14 are interconnected by a crossbar 20. A brace 22 having cranked end portions 24 extends between the crossbars 20. Apertures 26 in crossbar 20 receive the cranked end portions 2 of brace 22.

With the crossbars 20 parallel, the brace 22 extends at right angles from one to the other and thus, each crossbar 20 and brace 22 are secured, in a substantially rigid wedged joint.

Screws 28 inserted through holes 17, 19 in the legs 16, 18 secure the leg assemblies 14 to the seat 12. In the illustrated embodiment the leg 18 is longer than leg 16, to provide a slope to the seat.

As shown in FIG. 5, the elements 20, 22, 24, 26 are pre-torqued and tend to jam or wedge together. It will be noted that the ends of the brace are at approximately 55° from the main axis of the brace, thus providing the wedging and pre-torqued effect.

The chair may or may not have a back; the leg may be H-shaped rather than U-shaped; the material of which the legs are made may be tubular or solid; and the brace could be of some material other than steel.

The chair is assembled by attaching one leg assembly 14 to seat 12 by screws 28. The brace 22 is then inserted into apertures 26 of both leg assemblies. In order to align the leg assemblies 14 into the correct position on the underside of the seat 12, the assembler will have to exert a slight bias against the brace 22, which will pre-torque the brace. Holding the second leg assembly 14 in this position, the assembler will then screw the second leg assembly to the underside of the seat 12.

In use, the brace will thus be stressed or biased to hold the leg assemblies in a substantially rigid position. The joints between the brace and the crossbars will tend, by this bias, to be held together.

It will be understood that the foregoing description and illustrated embodiments are illustrative of the invention, changes and modifications to which can be effected within the scope of the attached claims.

The embodiments of the invention in which an exclusive property or privilege is claimed are defined as follows:

1. A chair, comprising;

(i) a seat;

(ii) two spaced leg assemblies, each leg assembly comprising two spaced legs and a crossbar extending between said spaced legs and attached at its ends to said spaced legs, the crossbar spaced down from the top ends of said legs, and means attaching said legs at said top ends to said seat;

(iii) a substantially rigid resilient pre-torqued brace having a main axis, extending between the crossbars of said leg assemblies, and having a connection at each end with a crossbar, each connection comprising a shaped end portion inclined at an angle to the main axis and a restricted, transversely extended passage in the crossbar, said shaped end extending obliquely in said passage, wedged across opposed wall portions of the passage.

2. The chair set forth in claim 1, said brace being a slender, steel bar.

3. The chair set forth in claim 1, wherein said crossbars each consist of a hollow tube having a transversely extending hole opening towards the hole in other tube to receive said brace.

4. A chair, comprising;

(i) a seat;

(ii) two spaced leg assemblies, each leg assembly comprising two spaced legs, and a crossbar extending between said spaced legs and attached at its ends to said spaced legs, the crossbar spaced down from the top ends of said legs, and means attaching said legs at said top ends to said seat;

(iii) a resilient pre-torqued brace extending between the crossbars of said leg assemblies and having a connection at each end with a crossbar, each connection comprising an aperture in said crossbar and a formed end on said brace positioned in said aperture, the formed end of the resilient pre-torqued brace and engagement of said end with said aperture producing a wedging action in said aperture to secure said brace to said crossbar.

5. A chair, comprising:

(i) A seat with two spaced apart U-shaped tubular metal leg assemblies, each leg assembly comprising two legs representing the vertical parts of the U, and a crossbar representing the bottom of the U, the leg assemblies attached at top ends to the seat;

(ii) A resilient pre-torqued brace connecting the crossbars of the leg assemblies, the brace having angled ends and said crossbars each having a hole for reception of an angled end of said brace, said angled ends of the resilient pre-torqued brace and engagement of said ends with said hole producing a wedging action in said holes to secure said brace to said crossbar.

6. The chair set forth in claim 5, each said crossbar consisting of a hollow tube having a transversely extending hole, each hole opening towards the hole in the other tube, to receive said formed end of said brace.

* * * * *